US005803228A

United States Patent [19]

Lucas

[11] Patent Number: 5,803,228

[45] Date of Patent: Sep. 8, 1998

[54] PARKING METER ASSEMBLIES

[76] Inventor: Tom Lucas, 421 East 29th Street, North Vancouver, British Columbia, Canada, V7N 1E2

[21] Appl. No.: 721,630

[22] Filed: Sep. 26, 1996

[51] Int. Cl.[6] ..... G07F 17/24

[52] U.S. Cl. ..... 194/350

[58] Field of Search ..... 194/350, 900; 232/7, 15, 16; 52/726.4; 403/377

[56] References Cited

U.S. PATENT DOCUMENTS

| | | | |
|---|---|---|---|
| 2,229,183 | 1/1941 | Mitchell | 194/900 X |
| 3,667,405 | 6/1972 | Roach | 232/7 X |
| 3,770,090 | 11/1973 | Fayling et al. | 194/350 |
| 4,133,419 | 1/1979 | Greenwald et al. | 194/350 |

*Primary Examiner*—F. J. Bartuska
*Attorney, Agent, or Firm*—Milde, Hoffberg & Macklin, LLP

[57] ABSTRACT

A parking meter assembly has a housing formed of housing portions of sheet steel secured together by welds. A coin receptacle is provided within the housing for receiving coins inserted through one or two parking meter heads mounted on the housing. To provide access to the coin receptacle, the housing is provide with an opening, a closure member and a lock, the closure member being securable by the lock in a closure position in the opening so as to close the opening. The housing also includes a vertical hollow cylindrical member upstanding from the underside of the housing into the interior of the housing, with a fastener provided within the housing and accessible through the opening, the fastener being adjustable to secure the cylindrical member and, thus, the remainder of the housing to a top portion of a support post inserted into the cylindrical member.

12 Claims, 4 Drawing Sheets

PARKING METER ASSEMBLIES

BACKGROUND OF THE INVENTION

1. Field of the Invention

The present invention relates to parking meter assemblies and is useful for parking meter assemblies having one or more parking meter heads.

2. Description of the Related Art

Conventional parking meters comprise a housing, sometimes referred to as "a vault", in the form of a metal casting, which is secured to a post, with one or more parking meter heads projecting upwardly from the top of the housing. To enable coins to be collected from the interior of the housing, there is provided within the housing a coin receptacle for collecting coins inserted through the coin inlets, and the housing is provided with an access opening which can be closed by a hinged door, a lock being provided for securing the door in a closed position in the opening. When the door is open, the coin receptacle is accessible through the access opening for removal from the housing.

It is a disadvantage of such a conventional parking meter assembly that, because the housing is formed of a metal casing, the housing is relatively brittle and therefore is vulnerable to being shattered by blows by a hammer and another object. Also, the door is vulnerable to such blows. These parking meter assemblies can thus be vandalized and, when this occurs, the entire casting usually has to be replaced, since it is not feasible to repair a shattered casting.

Furthermore, such a prior parking meter housing is secured by an expansible anchor to the top of a hollow post, the anchor depending from the underside of the housing and being inserted downwardly into the interior of the post and then being expanded radially outwardly into frictional gripping engagement with the inner surface of the post.

This type of securement of the parking meter assemblies results in an arrangement which may be vulnerable to rotation of the housing about the post and/or to the effects of blows directed upwardly against the housing and tending to force the housing upwardly from the post.

BRIEF SUMMARY OF THE INVENTION

It is accordingly an object of the present invention to provide a novel and improved parking meter assembly which is more resistant to impacts than conventional parking meters.

According to the present invention, there is provided a parking meter assembly which has a housing formed of housing portions of sheet steel, which are secured together by welds. A coin receptacle is provided within the housing for receiving coins inserted through one or two parking meter heads mounted on the housing.

To provide access to the coin receptacle, the housing is provided with an opening, a closure member and a lock, the closure member being securable by the lock in a closure position in the opening so as to close the opening.

The housing also includes a vertical hollow cylindrical member upstanding from the underside of the housing into the interior of the housing, with a fastener provided within the housing and accessible through the opening, the fastener being adjustable to secure the cylindrical member and, thus, the remainder of the housing to a top portion of a support post inserted into the cylindrical member. The fastener comprises one or more bolts inserted through openings in the cylindrical member and the support post.

Since the housing according to the present invention is formed of housing portions of sheet steel which are welded together, the housing is substantially stronger, and more resistant to impacts, than the prior art housings discussed above.

The provision of the cylindrical member provides a stronger and more-vandal resistant securement of the parking meter assembly to the post then is possible with prior art parking meter assembly housings of cast metal, to which a comparable cylindrical member cannot be welded.

According to a preferred embodiment of the invention, the cylindrical member penetrates the underside of the housing and projects upwardly and downwardly from the underside of the housing, so that the cylindrical member has a length which is sufficient to provide a strong connection between the housing and the post, i.e. a connection which resists a displacement of the housing by twisting or pounding transversely of the length of the post.

To reinforce the closure member against impacts, for example hammer blows, there is provided, in a preferred embodiment of the invention, a reinforcement of sheet steel which extends around the opening within the housing and projects inwardly of the opening so as to form an abutment for the closure member when the closure member is located in its closure position in the opening.

The arrangement is preferably such that the closure member, in its closure position, is flush with the housing, at the exterior of the housing, thus avoiding any projection of the closure member from the housing which could facilitate leverage of the closure member relative to the housing.

To protect the coin inlet, there is also provided, in the preferred embodiment of the invention, a cover of sheet steel which is secured over the coin inlet, with the coin inlet projecting through a top opening in the cover. The cover has opposed vertical parallel walls, lower portions of which fit through slots formed in the top of the housing and are secured by retainer members within the housing, the retainer members being accessible through the opening.

BRIEF DESCRIPTION OF THE DRAWINGS

Further features, objects and advantages of the present invention will become more readily apparent from the following description of preferred embodiments given, by way of example, with reference to the accompanying drawings, in which.

DESCRIPTION OF THE PREFERRED EMBODIMENTS

Figure 1:
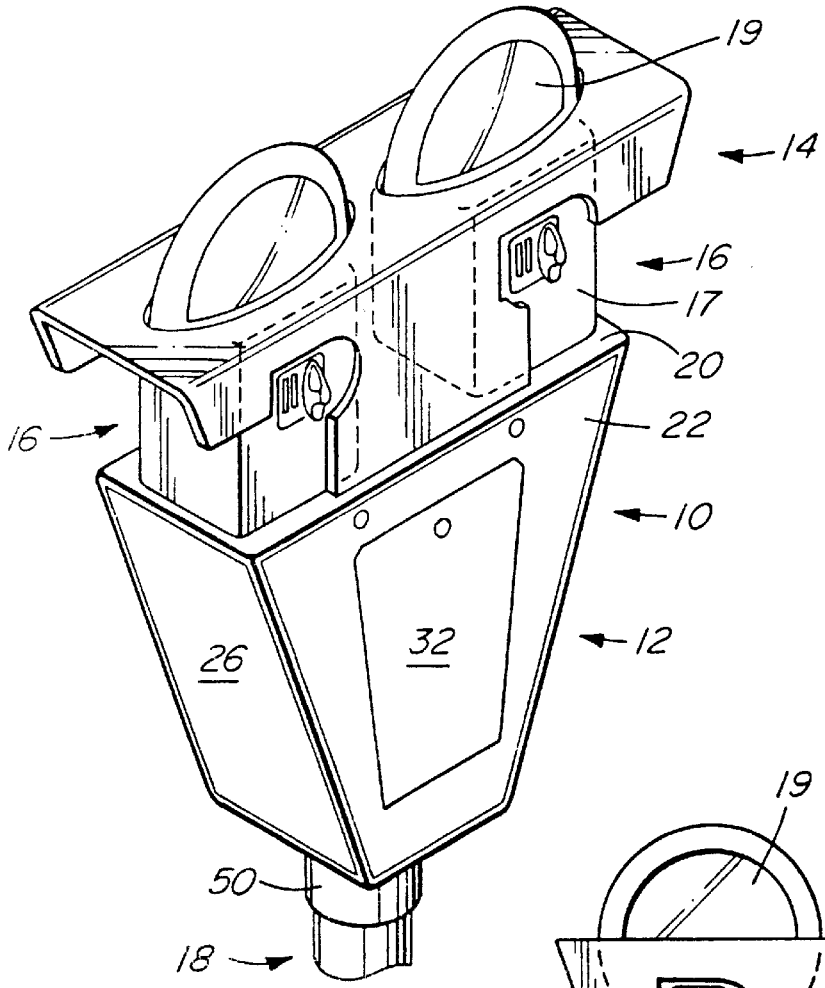
FIG. 1 shows a view in perspective of a dual-head parking meter assembly according to the present invention.
Figure 2:
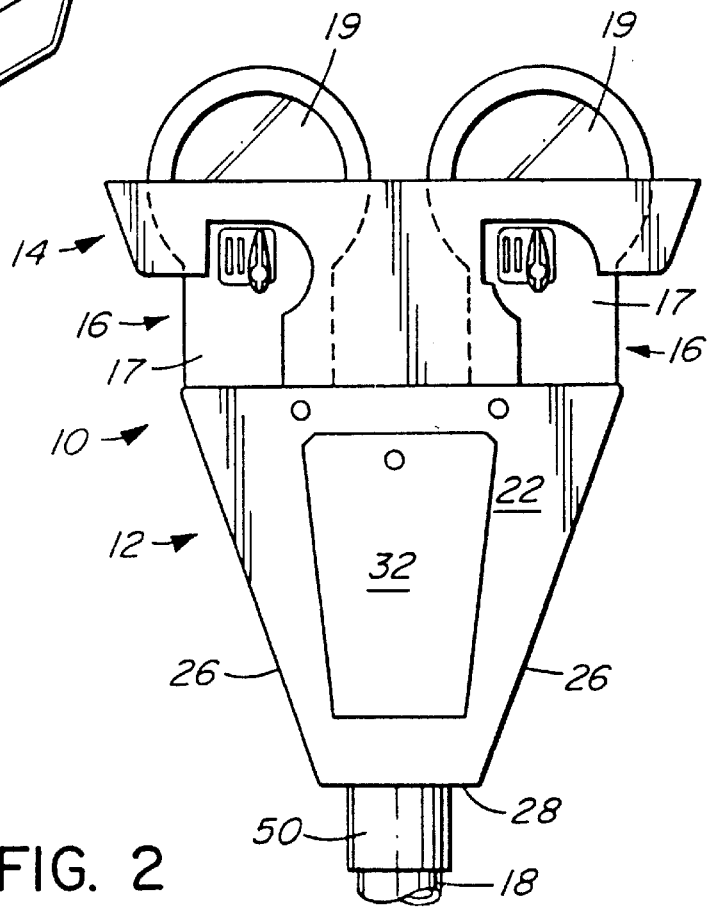
FIG. 2 shows a view in front elevation of the parking meter assembly of FIG. 1.

In FIG. 1 of the accompanying drawings, there is illustrated a parking meter assembly indicated generally by reference numeral 10, which comprises a vault or housing indicated generally by reference numeral 12 and a cover indicated generally by reference numeral 14. Two parking meter heads, indicated generally by reference numerals 16, are mounted, on the top of the housing 12, in a manner described in greater detail below and the entire parking meter assembly 10 is mounted on the top of a vertical post, which is indicated generally by reference numeral 18 and which, for convenience of illustration, is shown broken-away in the drawings.

Each parking meter head 16 comprises a housing 17, containing a conventional coin controlled timing and indicator mechanism (not shown) and a window 19, through which a pointer (not shown) and a scale (not shown) can be observed. Instead of pointers and scales, the heads 16 may employ liquid crystal displays or other displays well known in the art.

Figure 4:
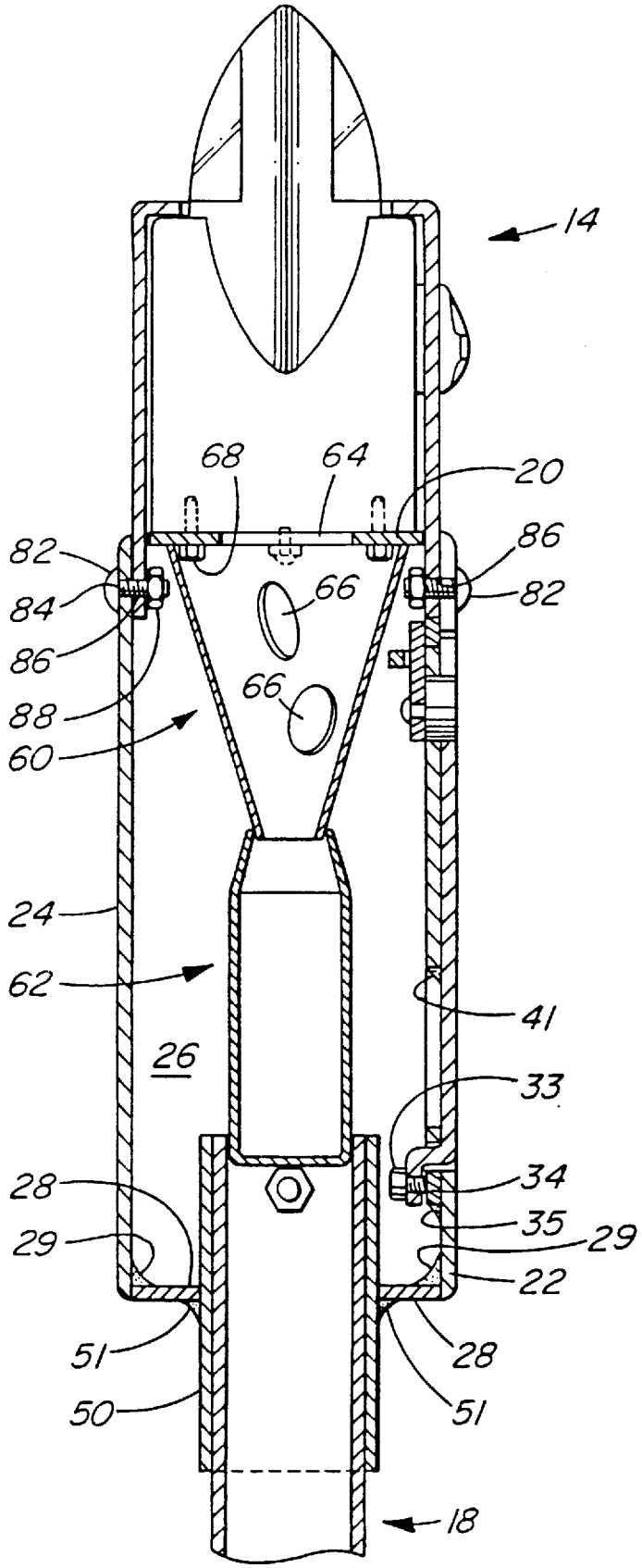
FIG. 4 shows a view taken in cross-section along the line 4—4 of FIG. 2.

The housing 12 is made of ¼ inch sheet stainless steel, although mild steel may alternatively be employed, and has a flat, horizontal top 20, a flat vertical front wall 22, a flat vertical rear wall 24, which is parallel to the front wall 22, a pair of flat downwardly convergent side walls 26, and a flat bottom wall 28. The front and rear walls 22 and 24 and the top 20 are formed in one piece by stamping and the bottom wall 28 and the side walls 26 are formed in another piece by stamping, these two pieces being secured together by welds 29 (FIG. 4).

The front wall 22 is formed with a trapezoidal access opening 30, which provides access to the interior of the housing, and a correspondingly trapezoidally shaped closure member 32 fits into the opening 30 for closing the housing 12.

Within the housing, there is provided a sheet steel reinforcement 34, which is secured by a weld 35 (FIG. 4) to the inner side of the front wall 22 and which projects inwardly of the opening 30, around the entire periphery of the opening 30.

At the bottom of the opening 30, the reinforcement 34 is provided with two spaced-apart horizontally extending slots 36. The closure member 32 is formed with two offset lugs 38 which, when the closure member 32 is located in a closure position in the opening 30 as shown in FIG. 4, project through the slots 36 for retaining the closure member 32 in the opening 30. The lugs 38 each have a retaining bolt 33, of which only one is shown, in threaded engagement therewith for retaining the lugs 38 in the slots 36 when the closure member 32 is opened.

When the closure member 32 is in its closure position, the inner side of the closure member 32 abuts the outer face of the reinforcement 34, with the closure member 32 then being flush with the front wall 22 at the exterior of the housing, as can be seen from FIG. 4. Consequently, when the closure member 32 is in its closure position, it does not present any edge projecting outwardly beyond the front wall 22 which could possibly facilitate jimmying or chiselling of the closure member 32 from the opening 30.

At its inner side, the closure member 32 is provided with a reinforcement plate 40, which is secured to the closure member 32 by a weld 41 and which, at its top, is formed with an inwardly projecting flange 42 in which there is cut a slot 44.

The closure member 32 is provided with a lock, indicated generally by reference numeral 46, having a latch 48 which pivots upwardly through the slot 44 so as to engage behind the reinforcement 34, as shown in FIG. 4, for locking the closure member 32 in its closure position in the opening 30. As can be seen from FIG. 3, the lock 46 extends through the closure member 32 and through the reinforcement plate 40 and the latter therefore serves to reinforce the closure member 32 at the location of the lock 46.

Figure 3:
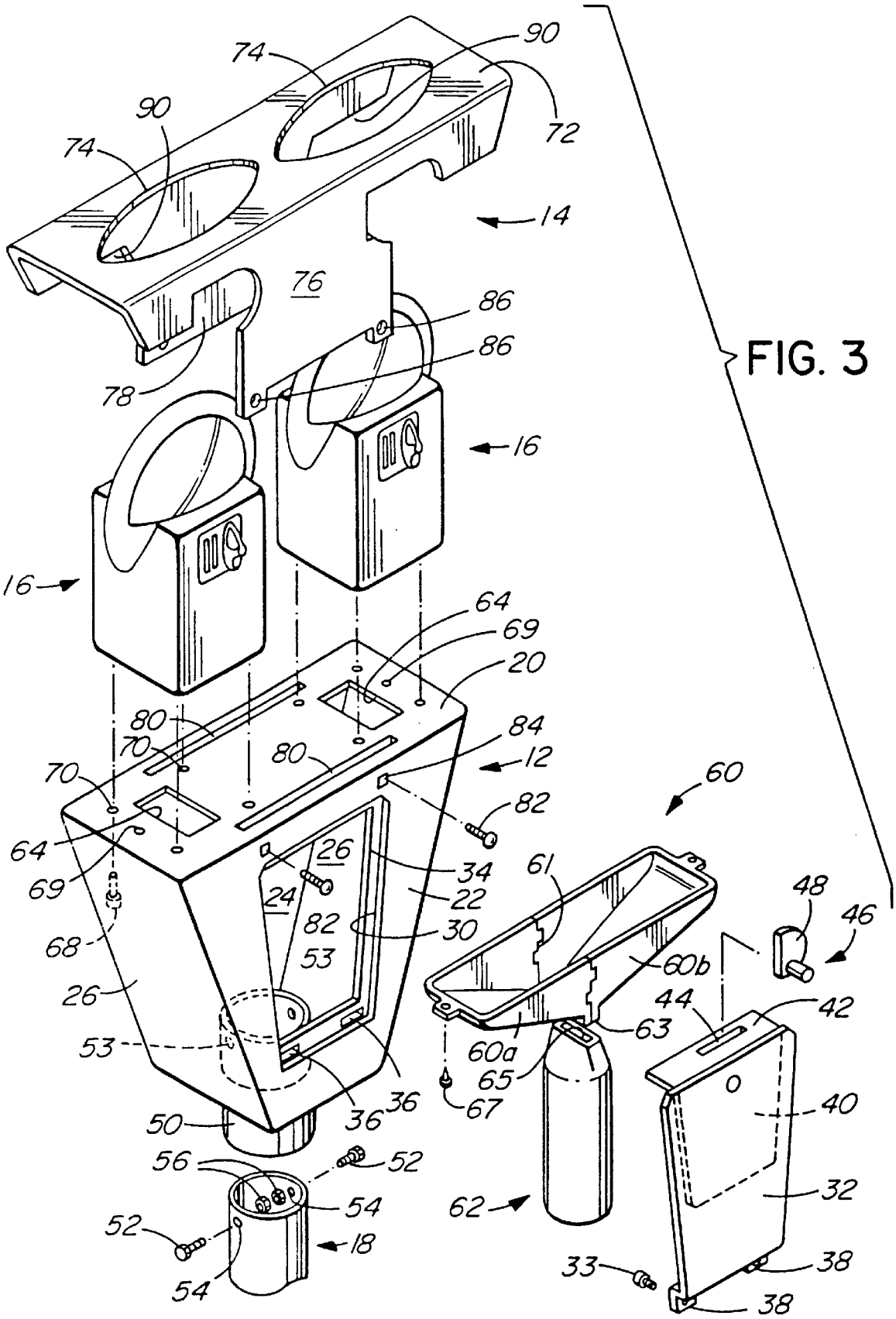
FIG. 3 shows an exploded view of the parking meter assembly of FIG. 1.

The housing 12 includes a hollow vertical cylindrical member or sleeve 50 which, as can be seen from FIGS. 3 and 4, extends through the bottom 28 of the housing and projects upwardly and downwardly from the bottom 28, the cylindrical member 50 being secured by a weld 51 to the bottom 28.

The cylindrical member 50 serves to receive an upper portion of the post 18, and is retained on the post 18 by bolts 52 (FIG. 3), which are inserted through openings 53 in the cylindrical member 50 and through openings 54 in the post 18. The openings 53 and 54 are aligned with one another to receive the bolts 52 therethrough, and the bolts 52 are retained by threaded engagement with retaining nuts 56 within the post 18. The bolts 52 and the nuts 56 are accessible, for adjustment and tightening thereof, through the access opening 30 in the housing 12 when the closure member 32 is removed from its closure position in the opening 30.

The housing 12 contains a coin chute, indicated generally by reference numeral 60, and a coin receptacle, indicated generally by reference numeral 62, for receiving and storing coins inserted into the parking meter assembly through the coin inlets 16. The housing top 20 is, for that purpose, formed with two rectangular coin openings 64, through which coins 66 can drop from the coin inlets 16 through the chute 60 into the receptacle 62.

The coin chute 60 is formed of two separate halves **60*a* and 60*b*, which have interengaged irregularly-shaped edges 61 and which form, at the underside of the coin chute 60, a depending nozzle-shaped coin outlet 63. The coin receptacle 62, which is made of plastic material, has at its top a mouth 65 shaped to receive the coin outlet 63. The two halves 60*a* and 60*b* of this coin chute 60 are secured to the housing 12 by screws 67 (of which only one is shown) in threaded engagement in holes 69 in the housing 12, and are made of sheet steel having a thickness which is sufficiently small, and which in the present embodiment is 1/32 inch, to allow flexing of the coin chute 60 when the coin receptacle 62 is inserted into or removed from the position in which it is shown in FIG. 4. In this position, the lower end of the coin receptacle 62 fits into the upper end of the post 18 and the underside of the coin receptacle 62 is supported on the nuts 56. The flexing of the coin chute 60 is sufficient to enable the coin receptacle to be inserted into and removed from the position in which it is shown in FIG. 4 through the opening 30 in the housing 12**.

The parking meter heads 16 are secured to the upper surface of the housing top 20 by means of bolts 68 which are inserted from the interior of the housing 20 through openings 70 in the housing top 20 and into threaded engagement with the undersides of the coin inserts 16.

The cover 14 has a top 72, which is formed with two openings 74 through which the tops of the meter heads 16 project, and vertical, parallel front and rear walls 76 and 78. The housing top 20 is formed with two parallel slots 80, which serve to receive therethrough lower portions of the cover walls 76 and 78. Coach bolts 82 are inserted through square holes 84 in the housing 12 and holes 86 in the vertical walls 76 and 78 of the cover 14, respectively, for securing the cover 14 to the housing 12, the coach bolts 84 being retained by threaded engagement with nuts 88.

As can be seen from FIG. 4, when the lock 46 is closed, the latch 48 engages behind the vertical wall 76 of the cover 14.

The front and rear vertical wall 76 and 78 of the cover 14 are formed with cutouts 90 to allow insertion of coins into the parking meter heads 16 and also to allow actuation of the levers (not shown) of the coin inlets 16.

Figure 5:
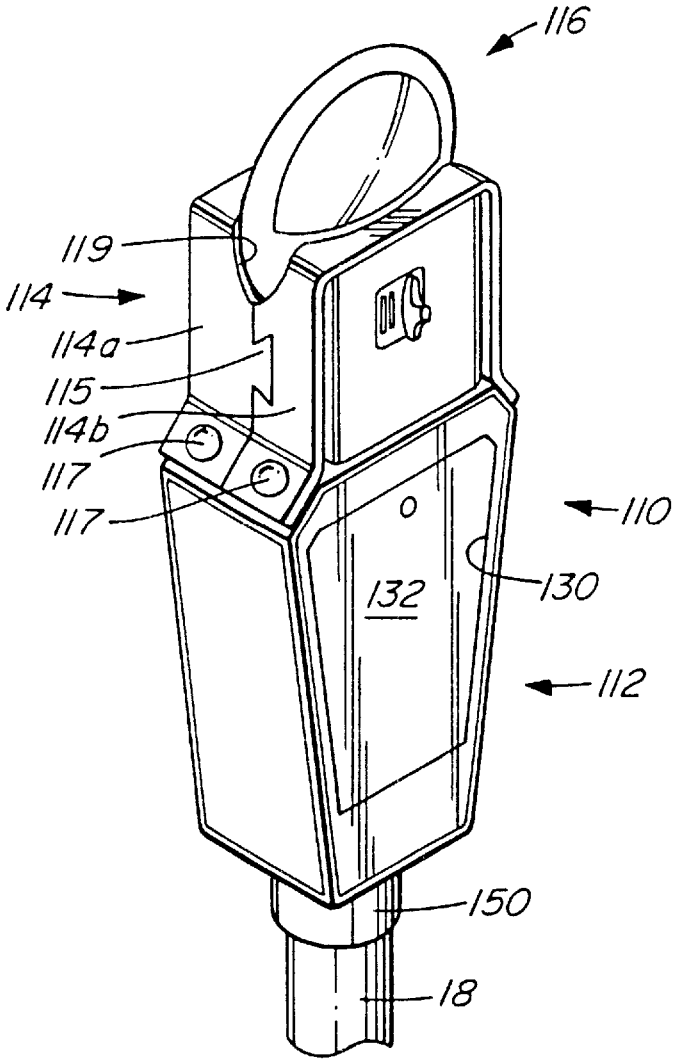
FIG. 5 shows a view in perspective of a single-head parking meter assembly according to the present invention.

FIG. 5 shows a modification according to another embodiment of the present invention, which is in the form of a single-head parking meter indicated generally by reference numeral 110, which comprises a housing indicated generally by reference numeral 112 and a parking meter head indicated generally by reference numeral 116.

The housing 112 is made of sheet stainless steel, like the housing 12, and has an opening 130 into which fits a closure member 132 of the same trapezoidal shape as the closure member 32.

The housing 112 is also provided with a cylindrical member 150 extending through and welded to the bottom wall (not shown) of the housing 112, and the housing 112 is secured to the post 18, in a manner similar to that described above with reference to the housing 12.

The parking meter head 116 is protected by a cover indicated generally by reference numeral 114, which is made of stainless steel in two halves 114*a* and 114*b*, having interengaged dovetail edges 115. The two halves 114*a* and 114*b* are secured to the housing 112 by coach bolts 117, and the cover 114 is formed with an opening 119 through which extends the parking meter head 116.

Since the housings 10 and 110 are made of stainless steel, they can readily be provided with a silk screened imprint or a decal. Also, the use of stainless steel enables the housings 10 and 110 to be drilled when it is required to adapt them for different uses after they have been manufactured.

Furthermore, if the housings 10 and 110 become damaged during use, e.g. as a result of vandalism, the use of steel enables them to be repaired, e.g. by patching and welding, in a manner that would be impossible with prior art parking meter housings formed as castings, which need to be entirely replaced when they are damaged.

As will be apparent to those skilled in the art, various modifications may be made to the above-described assemblies within the scope of the appended claims.

What is claimed is:

1. A parking meter assembly, comprising:

a housing made of sheet steel;

said housing having a hollow interior, an access opening providing access to said hollow interior, a sheet steel closure member shaped to fit and close said opening and a lock for releasably securing said closure member in a closure position in said opening;

at least one parking meter head mounted on said housing; and a protective cover fitted over said parking meter head, said protective cover being made of sheet steel and comprising a top and a pair of walls depending from said top;

said housing being formed with slots, said walls extending downwardly through said slots and retainers being provided within said housing and releasably engaging said cover for retaining said cover in position over said head.

2. A parking meter assembly as claimed in claim 1, wherein said parking meter is one of a pair of parking meters spaced apart on said housing by a gap, and said top and said walls extend across and close said gap.

3. A parking meter assembly as claimed in claim 1, wherein said parking meter has an upper portion provided with a window, and said top of said cover is formed with an opening for receiving said upper portion therethrough.

4. A parking meter assembly, comprising:

a post;

said post having an upper portion;

a housing mounted on said upper portion of said post;

a parking meter head mounted on said housing;

said parking meter head having a coin inlet;

a coin receptacle within said housing for receiving coins inserted into said coin inlet;

said housing having an opening through which said coin receptacle is accessible, a closure member for closing said opening and a lock for securing said closure member in a closed position in said opening;

said housing further having a bottom;

a vertical hollow cylindrical member extending through and fixedly secured to said housing bottom, said cylindrical member projecting upwardly and downwardly from said housing bottom and receiving therein said upper portion of said post; and a fastener located within said housing and securing said cylindrical member to said upper portion of said post.

5. A parking meter assembly as claimed in claim 4, wherein said cylindrical member is welded to said housing bottom.

6. A parking meter assembly as claimed in claim 4, wherein said housing is formed of housing portions of sheet steel and welds securing said housing portions together, and further comprising a further weld securing said cylindrical member to said housing bottom.

7. A parking meter assembly as claimed in claim 4, wherein said housing includes a reinforcement located within and secured to said housing and projecting behind said opening to form an abutment for said closure member such that said closure member, when in said closed position, abuts said reinforcement and is flush with said housing at the exterior of said housing.

8. A parking meter assembly as claimed in claim 7, wherein said closure member and said reinforcement have interengageable lug and slot formations for retaining said closure member relative to said housing when said closure member is in an open position.

9. A parking meter assembly as claimed in claim 7, including slot formations in said reinforcement and lug formations on said closure member and projecting through said slot formations to retain said closure member relative to said housing when said closure member is in an open position, said assembly further comprising retaining members in threaded engagement with said lug formations for releasably retaining said lug formations in said slot formations.

10. A parking meter assembly, comprising:

a post;

said post having an upper portion;

a housing made of sheet steel mounted on said upper portion of said post;

a parking meter head mounted on said housing;

said parking meter head having a coin inlet;

a coin receptacle within said housing for receiving coins inserted into said coin inlet;

said housing having an opening through which said coin receptacle is accessible, a closure member for closing said opening and a lock for securing said closure member in a closed position in said opening;

said housing further having a bottom;

a vertical hollow cylindrical member extending through and fixedly secured to said housing bottom, said cylindrical member projecting upwardly and downwardly from said housing bottom and receiving therein said upper portion of said post;

a fastener located within said housing and securing said cylindrical member to said upper portion of said post;

a protective cover fitted over said parking meter head, said protective cover being made of sheet steel and comprising a top and a pair of walls depending from said top;

said housing being formed with slots, said walls extending downwardly through said slots and retainers being provided within said housing and releasably engaging said cover in position over said head;

a further member secured to said housing within said housing and projecting behind said opening; and interengageable formations on said closure member and said further member for releasably retaining said closure member in said opening when said closure member is in said closed position.

11. A parking meter assembly as claimed in claim 10, wherein said further member comprises a sheet steel reinforcement within said housing and secured by welding to said housing with said reinforcement projecting behind said opening to form an abutment for said closure member.

12. A parking meter assembly as claimed in claim 10, wherein said closure member is provided with a reinforcement plate welded to said closure member, said lock being fitted through said closure member and said reinforcement plate.

* * * * *